US008904848B2

(12) United States Patent
Frenken

(10) Patent No.: US 8,904,848 B2
(45) Date of Patent: Dec. 9, 2014

(54) PRESSING DEVICE

(75) Inventor: Egbert Frenken, Heinsberg (DE)

(73) Assignee: Gustav Klauke GmbH, Remscheid (DE)

( * ) Notice: Subject to any disclaimer, the term of this patent is extended or adjusted under 35 U.S.C. 154(b) by 86 days.

(21) Appl. No.: 13/287,783

(22) Filed: Nov. 2, 2011

(65) Prior Publication Data

US 2013/0042460 A1 Feb. 21, 2013

(30) Foreign Application Priority Data

Aug. 19, 2011 (DE) ..... 10 2011 052 852

(51) Int. Cl.
*B21J 13/00* (2006.01)
*B21D 39/04* (2006.01)
*B25B 27/10* (2006.01)

(52) U.S. Cl.
CPC ..... *B21D 39/048* (2013.01); *B25B 27/10* (2013.01)
USPC ..... 72/416; 72/450; 72/402

(58) Field of Classification Search
USPC ..... 72/402, 298, 295, 399, 463, 269, 462, 72/416, 412, 465.1, 46.4, 46.1, 290, 289, 72/314, 312, 311, 300, 292, 450
See application file for complete search history.

(56) References Cited

U.S. PATENT DOCUMENTS 2,973,024 A 2/1961 Merriman
3,662,450 A 5/1972 Kish et al.
4,250,607 A * 2/1981 Lillbacka et al. ..... 72/402
4,854,031 A * 8/1989 Eisenzimmer ..... 29/508
5,335,530 A 8/1994 Homm
5,666,711 A 9/1997 Pfeiffer
6,044,686 A 4/2000 Dischler
6,324,884 B1 * 12/2001 Barjesteh et al. ..... 72/402
6,415,641 B1 7/2002 Wagner
6,477,757 B2 11/2002 Viegener
6,484,553 B1 11/2002 Devers
6,772,618 B2 8/2004 Frenken
7,143,626 B2 12/2006 Dole (Continued)

FOREIGN PATENT DOCUMENTS

CA 2 555 605 2/2008
DE 19734355 4/1999

(Continued)

OTHER PUBLICATIONS

International Search Report, for PCT/EP2012/065244, Oct. 26, 2012 (non-English).

*Primary Examiner* — Shelley Self
*Assistant Examiner* — Pradeep C Battula
(74) *Attorney, Agent, or Firm* — Klintworth & Rozenblat IP LLC

(57) ABSTRACT

A chain-like pressing device and a method of using same for press-joining a tubular or hose-shaped workpiece with a fitting and/or a ferrule is provided. The device at least two pressing members interacting over the circumference in the radial direction. The pressing members can move relative to each other in the circumferential direction at their interacting surfaces that transmit the pressing force. The interacting surfaces enclose an angle of less than 180° therebetween. The pressing device includes a plurality of pressing members forming a first linkage for enclosing the workpiece, at least one of the pressing members transmits pressing force only by pressure or tension application through a further first pressing member.

21 Claims, 6 Drawing Sheets

(56) References Cited

U.S. PATENT DOCUMENTS

| | | | | |
|---|---|---|---|---|
| 7,347,457 | B2 | 3/2008 | Wulf et al. | |
| 7,779,523 | B2 * | 8/2010 | Frenken | 72/416 |
| 7,788,779 | B2 * | 9/2010 | Frenken | 72/402 |
| 8,336,177 | B2 * | 12/2012 | Vernasca et al. | 29/282 |
| 8,490,261 | B2 * | 7/2013 | Frenken et al. | 72/416 |
| 2003/0230132 | A1 | 12/2003 | Bowles et al. | |
| 2010/0229368 | A1 | 9/2010 | Frenken et al. | |
| 2011/0023573 | A1 | 2/2011 | Intagliata et al. | |

FOREIGN PATENT DOCUMENTS

| | | |
|---|---|---|
| DE | 198 26 110 | 12/1999 |
| DE | 199 58 103 | 3/2001 |
| DE | 20 2008 016 440 | 2/2009 |
| DE | 10 2008 057 424 | 5/2010 |
| DE | 20 2009 009456 | 11/2010 |
| DE | 10 2009 032 113 | 1/2011 |
| DE | 20 2011 004 259 | 5/2011 |
| EP | 1974836 | 7/2010 |
| EP | 2340899 | 7/2011 |
| GB | 987726 | 3/1965 |
| KR | 2011 069309 | 6/2011 |
| WO | 90 00098 | 1/1990 |
| WO | 2011/006778 | 1/2011 |

* cited by examiner

PRESSING DEVICE

FIELD OF THE INVENTION

The invention relates to a chain-like pressing device comprising in each case at least two pressing members interacting over the circumference in the radial direction, wherein the pressing members can move relative to each other in the circumferential direction at their interacting surfaces which transmit a pressing force, and all pressing members that press directly are acted on.

The invention further relates to a chain-like pressing device for press-joining a tubular or hose-shaped workpiece with a fitting and/or a ferrule, the pressing device comprising a plurality of first pressing members which represent chain links, are connected in a first linkage and are formed for enclosing the workpiece, at least one of which first pressing members transmits pressing force only by means of applying pressure or tension through a further first pressing member.

Furthermore, the invention relates to a method for press-joining a tubular or hose-shaped workpiece with a fitting and/or a ferrule, wherein pressing is carried out with a chain-like pressing device by means of a plurality of pressing members radially arranged next to each other, wherein the radially outer pressing members are directly acted on by a pressing force and transmit the pressing force onto the radially inner pressing members.

BACKGROUND OF THE INVENTION

Such pressing devices and methods for pressing have already become known in various aspects. For example, reference is made to WO 03/049883 A1 (U.S. Pat. No. 7,779,523 B2). The known pressing devices or the known methods for pressing appear to be improvable with regard to press-joining compression parts with different diameters with respect to subsequent pressing operations. Such a known pressing device and such a known method are designed to compress, with one configuration of the pressing device, a multiplicity of compression parts having the same dimensions with respect to the chain-like pressing device. Some pressing members of the known pressing device are acted on by other pressing members of the known pressing device by means of interacting surfaces following a circular shape in plan view. In the case of inner pressing members with a relatively large size in the circumferential direction, this configuration still allows an advantageous interaction. However, said configuration can be insufficient in the case of inner pressing members which are smaller in the circumferential direction.

SUMMARY OF THE INVENTION

Based on this, the invention is concerned, as object, with the provision of an advantageous chain-like pressing device for pressing in particular tubular or hose-shaped workpieces, which pressing device advantageously enables an interaction with inner pressing members which are relatively small in the circumferential direction and/or which enables, in a simple manner, compression partners with different diameters to be press-joined. Furthermore, the invention is concerned, as object, with the provision of a method for press-joining which is advantageous for this purpose.

A solution is provided by a pressing device wherein the interacting surfaces of a pair of interactingly arranged inner and outer pressing members are defined by surface portions enclosing an angle between them of less than 180°. A radially inner pressing member is acted on in a directionally advantageous manner by such an interacting surface of the outer pressing member, wherein said interacting surface is concave and extends differently from a circular shape. It has less possibility to move in the circumferential direction. An advantageous radial displacement during a pressing operation is also possible in the case of a pressing member having a relatively small dimension in the circumferential direction. In the case of the radially inner pressing member, the associated interacting surface is formed convex by the surface portions extending in the mentioned angular position with respect to each other. Also, it is possible to exchange the radially inner pressing members in an advantageous manner without the need of special efforts with respect to the interacting surfaces. By exchanging the inner pressing members, an advantageous adaptation to other diameters of the pressure partners can be achieved.

A further solution to the problem is in particular provided in the case of a chain-like pressing device in which the second pressing members are part of a further linkage, which further linkage can be exchangeably arranged within the first linkage, wherein the second pressing members can be subjected to pressing force for pressing the workpiece only by first pressing members. In this configuration, the further linkage allows the simple exchange of pressing members for adapting to compression partners with other (outer) diameters. Due to the fact that the second pressing members of the further linkage can be subjected to pressing force for pressing the workpiece only by the first pressing members, no changes with respect to the force transmission within the chain-like pressing device is required if, for example, the further linkage is exchanged with regard to the mentioned adaptation to other diameters.

Subject matter of the invention is also a linkage of pressing members for use in a pressing device by means of which, for example, a tubular or hose-shaped workpiece is press-joined with a fitting and/or a ferrule. The aim here is that a plurality of pressing members which are each mounted in one linkage part, wherein at least two linkage parts are provided to be pivotable relative to each other for opening the linkage, are mounted in the linkage parts in a radially movable manner. More preferably, said plurality of pressing members of this linkage are shaped identically with respect to each other and most preferably, all pressing members of this linkage are shaped identically with respect to each other.

A linkage of pressing members preferably consists of a plurality of pressing members which are connected together for handling. More preferably, they are separably connected together for being placed around an arrangement of parts to be joined by pressing, but otherwise, the individual pressing members cannot be readily detached, or not without time-consuming use of tools, from the linkage parts forming the linkage. A linkage part can also be implemented by a connecting part provided, if necessary in each case, on a pressing member, by means of which connecting part, the connection from one to a further pressing member is carried out.

With respect to the method, the aim is in particular that each radially outer pressing jaw acts on three or more radially inner pressing jaws. Hereby, a division into a large number of individual actions on the workpiece is achieved, wherein said actions are applied by a single outer pressing jaw. In this manner too, an adaptation to the compression partners actually to be joined by pressing can (in each case) be achieved in an advantageous manner.

Further features of the invention are described or illustrated below also in the description of the figures and the drawing and oftentimes in their preferred association with the already explained concepts; however, they can also be important in association with only one or a plurality of individual features described or graphically illustrated here, or independently or in another overall concept.

The chain-like configuration of the pressing device connects in any case three or more outer pressing members in such a manner to each other that—in the open state—said members can be pivoted relative to each other. A combination of compression parts arranged for being joined by pressing can be surrounded in an advantageous manner. Moreover, in the case of a chain-like pressing device, in contrast to pushing together two or more oppositely disposed pressing jaws, the compression is achieved by circumferentially shortening the device by a pressing force introduced in one direction. The linkage of the radially outer pressing members is preferably formed in a chain-like manner. However, the linkage of the radially inner pressing members can also be formed in a chain-like manner, but this not preferred.

In one preferred configuration it is provided, in first instance, that the pressing members arranged radially inward are arranged in groups of two or more members in an inherently rigid linkage part. Preferably, they are arranged in said linkage part to be radially movable relative to the latter, more preferably, to be movable only radially relative thereto. This relates to an arrangement in the pressing state. More preferably, at least two such linkage parts are provided which can also be provided such that they oppose each other and enclose the pressing member between them, thus, in this context, two groups of linkage parts are provided which, more preferably, are movable at a connection point relative to each other in an articulated manner for opening the inner linkage also with regard to surrounding a combination of compression parts to be joined by pressing.

More preferably, a linkage part, in particular of the linkage of the inner pressing members, is configured in a plate-like manner. Moreover, preferably in the direction of a longitudinal axis of a part to be joined by pressing, thus e.g. a hose part, it overlaps at least partially with the pressing members held together in this manner.

More preferably, the inner pressing members are secured by means of one or a plurality of these linkage parts to the chain-like linkage of the outer pressing members and furthermore, are preferably securable in a detachable manner.

Also, the inner pressing members are preferably mounted in the associated linkage parts so as to be radially movable to a limited extent for preferably radial movement relative to linkage parts which are stationary during pressing action. More preferably, this mounting is provided even without spring preload acting radially inwardly or radially outwardly. The usual radially outer initial position of the inner pressing members relative to the associated linkage parts at the beginning of a pressing operation arises solely from pushing the compression part into the pressing geometry (radially inner front faces of the inner pressing members) or from putting said linkage around the part to be joined by pressing.

It is also preferred that an inner pressing member of the second linkage is acted on by two radially outer pressing members of the first linkage. For this purpose, the pressing member of the inner linkage is preferably arranged such that it overlaps, in the circumferential direction, two pressing members of the outer linkage.

In further detail, the inner pressing members are provided radially on the inside with a pressing geometry having a circular plan view, whereas radially on the outside, the pressing members are provided with an interacting surface which deviates from a circular shape and serves for interacting with the radially outer pressing members. In plan view, the outer interacting surface can preferably be formed from straight portions which enclose an acute or obtuse angle between them.

Furthermore, it is preferred that the radially outer pressing members are connected to each other by means of articulated levers which are also to be designated as connecting bars, wherein further at least one radially outer pressing member is secured to a connecting bar between the ends of said connecting bar, each of which ends, in turn, form a pivotably movable connection with a further radially outer pressing member. In particular, with respect to this configuration of a chain-like pressing device, reference is made to the aforementioned WO 03/049883 A1 (U.S. Pat. No. 7,779,523 B2). In any case, two pressing members, in the present context outer pressing members, are pivotably connected to each other via two articulated levers configured as angle levers. The angle levers are pushingly supported on a first pressing member and both angle levers are connected to the same pressing member in a tensionally loaded manner. The tensile connection is achieved via the mentioned connecting bars. The angle levers pushingly supported on the first pressing member make it possible during a pressing operation to move the first pressing member centrally to the longitudinal axis of the workpieces to be joined by pressing. Due to the fact that the second pressing member is pulled by means of the angle levers, said second pressing member too can be pulled simultaneously and centrally onto the longitudinal axis of the workpieces. Movement of the pressing members in the circumferential direction is virtually non-existent.

The angle levers can each be connected in a toggle lever-like manner to a connecting bar that transmits tension force. In this respect, the angle lever is also to be designated as one of the two articulated levers of a toggle joint.

Furthermore, the disclosure content of this mentioned printed publication, with respect to the structure of the chain-like pressing device which is described therein and which in the present case preferably corresponds to the outer linkage, except for the interacting surfaces which are modified in the manner described herein, is incorporated herein by reference in the disclosure of the present application, including for the purpose of incorporating features of the mentioned printed publication in claims of the present application.

Furthermore, it is also preferred that an outer pressing member movably connected to a connecting bar is acted on in the longitudinal direction only by the further outer pressing members. The articulated lever itself transmits no pressing force.

DESCRIPTION OF THE DRAWINGS

The invention is further explained below with reference to the accompanying drawing which however only shows an exemplary embodiment. In the figures.

DETAILED DESCRIPTION OF THE ILLUSTRATED EMBODIMENT

Figure 1:
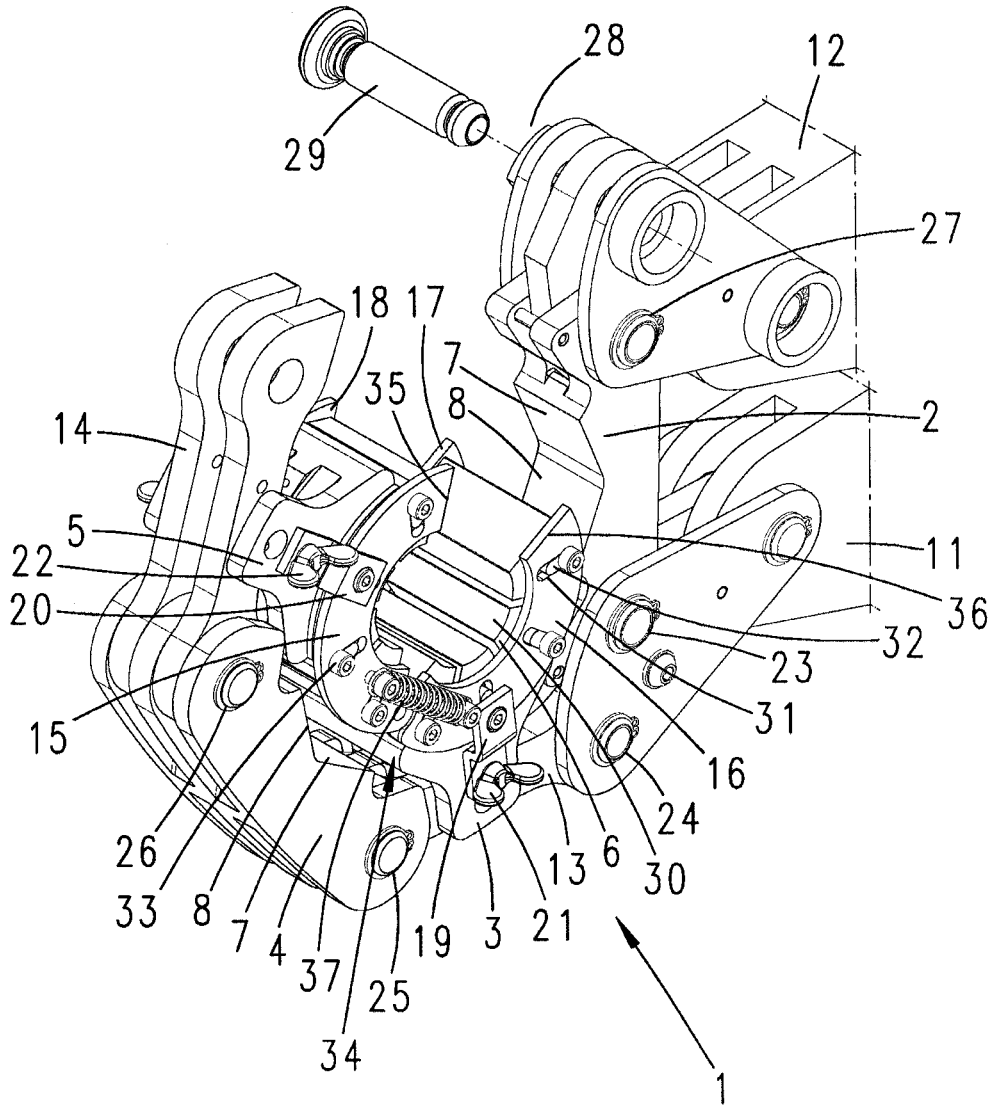
FIG. 1 shows a perspective illustration of the chain-like pressing device in the open state.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein. Therefore, unless otherwise noted, features disclosed herein may be combined together to form additional combinations that were not otherwise shown for purposes of brevity.

Illustrated and described is a chain-like pressing device 1 comprising outer pressing members 2, 3, 4 and 5 arranged over the circumference and located in an outer linkage and inner pressing members 6 located in an inner linkage.

Figure 2:
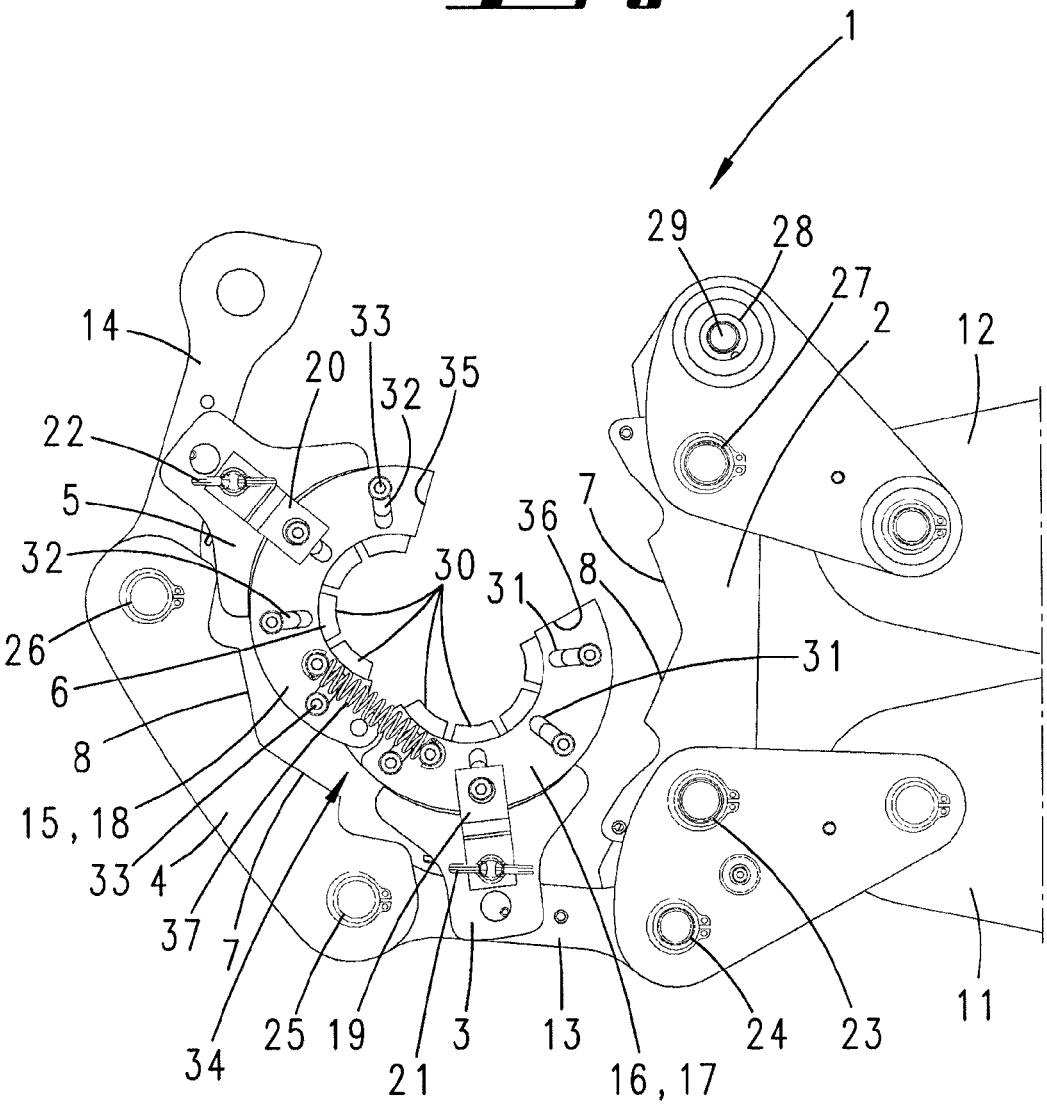
FIG. 2 shows an illustration according to FIG. 1 in a top view with a schematically indicated connection to a pressing tool.
Figure 3:
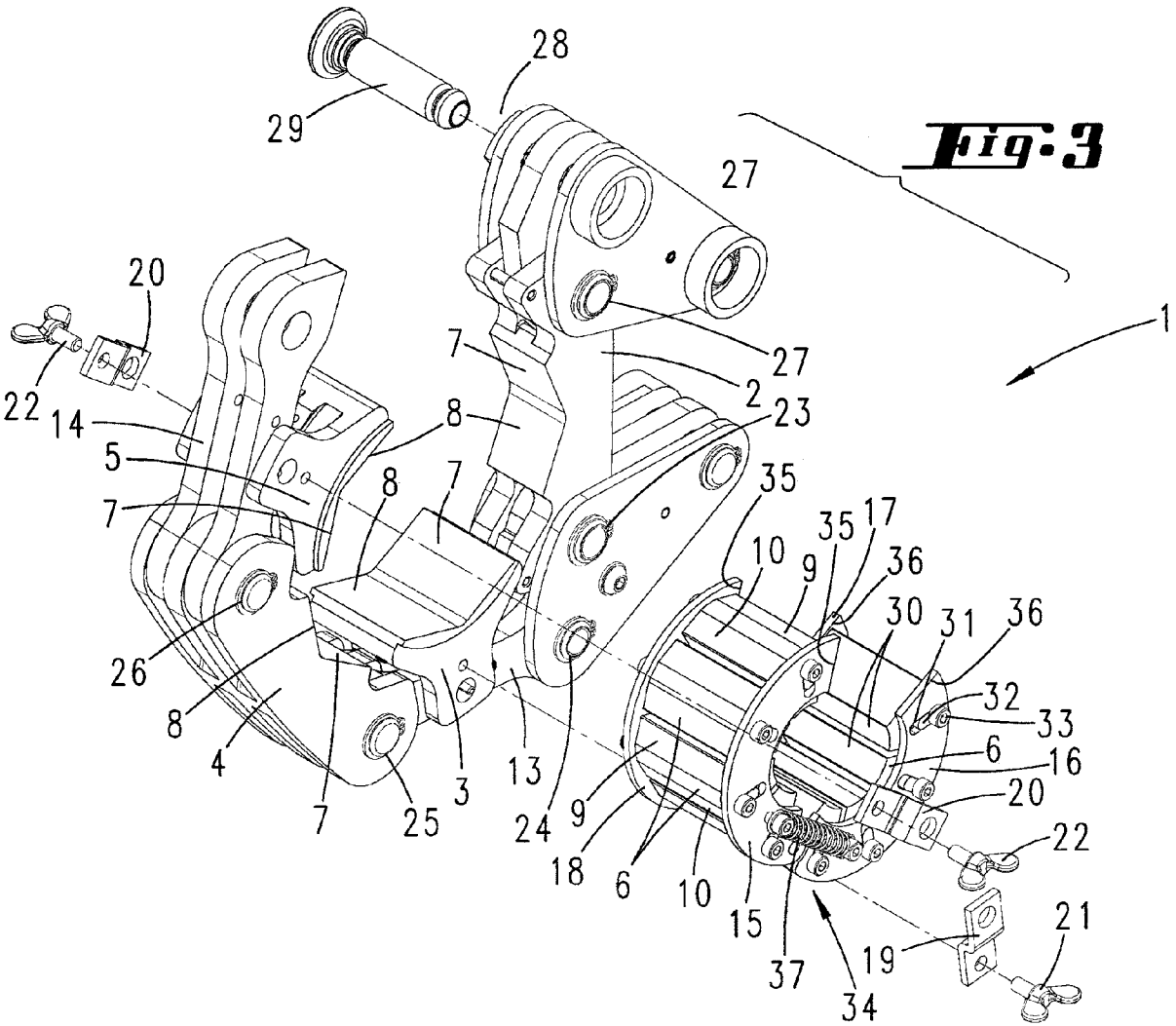
FIG. 3 shows an exploded view of the two linkages of pressing jaws engaged with each other in the state of use.
Figure 4:
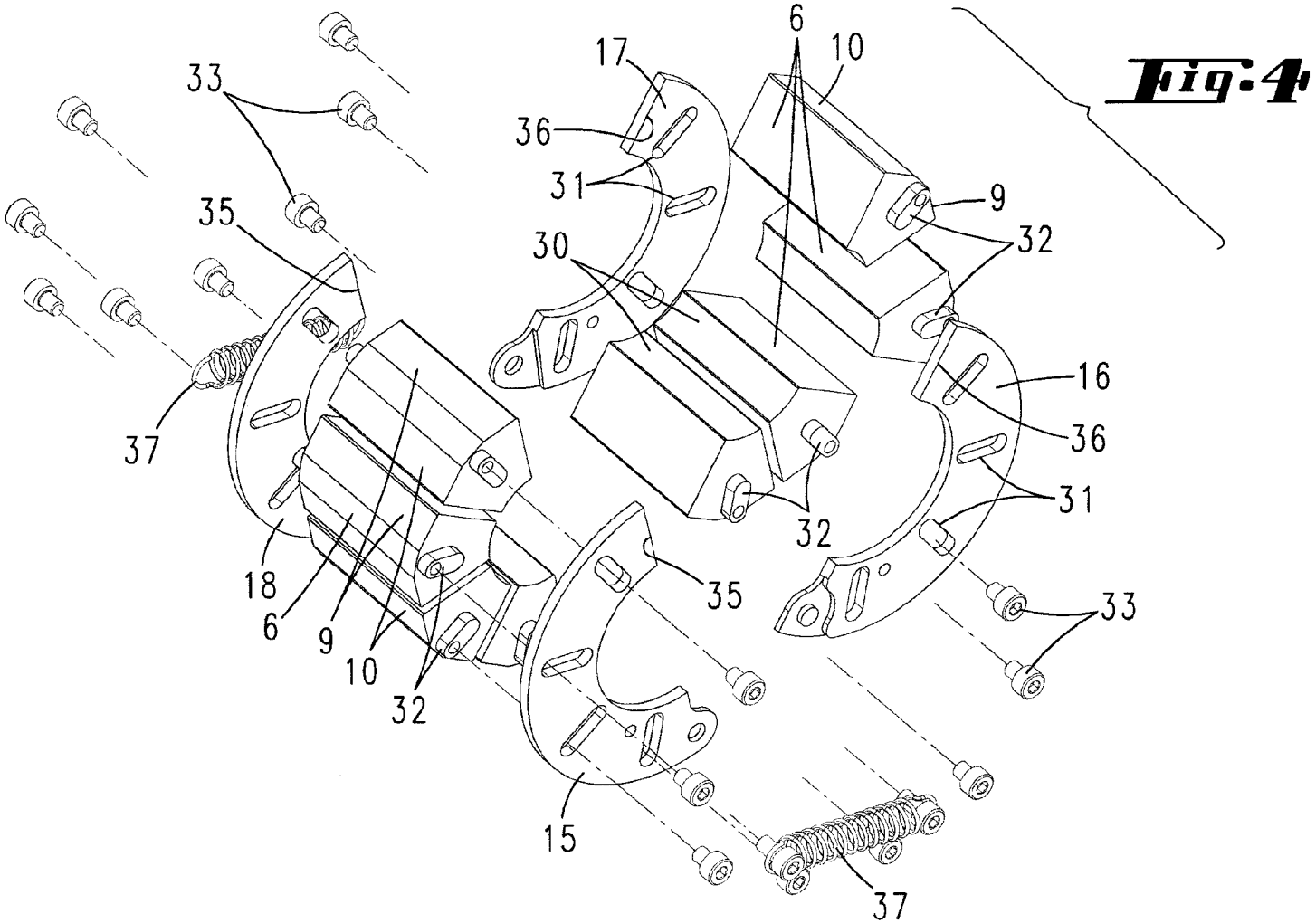
FIG. 4 shows an exploded view of the inner linkage of pressing jaws.

The outer pressing members 2, 3, 4 and 5 are connected to each other in the open state according to FIG. 1 or FIG. 2 via articulated joint connections 23, 24, 25, 26 and 27 in such a manner that they can be pivoted relative to one another in this open position. Spreading by pivoting is possible at a plurality of articulated joints 24, 25 and 26; in the exemplary embodiment, accordingly, at least at three articulated joints. Pivoting is carried out about an axis which is perpendicular to the pressing direction or about an axis which extends approximately parallel to a longitudinal axis of a compression part to be joined by pressing such as, for example, a hose part.

The outer pressing members 2 and 4 which oppose each other diametrically in the pressing state are connected to each other via connecting bars 13, 14. At least one articulated joint 28 can be opened, for example by a withdrawable connecting pin 29, see FIG. 1, in order to put the pressing device 1 in this open state around a combination of compression parts to be joined together by pressing. The inner linkage can also be opened in the same manner as explained in detail below.

The outer pressing members 2, 3, 4 and 5 and the inner pressing members 6 interact via interacting surfaces. Surface portions 7, 8 of the inner surface of the outer pressing members 2, 3, 4 and 5 engage surface portions 9, 10 of the outer surface of the inner pressing members 6. The surface portions 7, 8, 9, 10 extend differently from a circular shape. In the case of the exemplary embodiment, two straight surface portions 7, 8 and 9, 10 are involved which, in plan view, enclose an obtuse angle $\alpha$ of less than 180° therebetween, for example 100° to 170°, preferably 120° to 150°, more preferably 135° between them. The transition between two surface portions 7, 8 of an outer pressing member 2, 3, 4 and 5 or surface portions 9, 10 of an inner pressing member 6 is preferably configured such that in this region, a certain spacing is established between the pressing members and maintained during pressing. The surface portions 7, 8 and 9, 10 are in each case both formed on the same pressing member. Such an interacting surface enclosing an angle $\alpha$ is in each case formed preferably on an outer pressing member 2 and an inner pressing member 6.

Preferably, at least twice as many inner pressing members 6 as outer pressing members 2, 3, 4, 5 are provided.

A circular shape is formed by the inner surface portions 30 of the inner pressing members 6 in plan view when in the pressing condition. The outer surface portion 9, 10 of each inner pressing member 6 is preferably formed convexly. A non-circular shape is formed by the outer surface portions 9, 10 of the inner pressing members 6 in plan view when in the pressing condition. The inner surface portions 7, 8 of each outer pressing members 2, 3, 4, 5 is preferably formed concavely.

With respect to the mentioned ranges, in particular the mentioned angular range, all intermediate values are also included in the disclosure, in particular in steps of 1/10 of a dimension, thus in particular in steps of 1/10°, on the one hand for limiting the mentioned range limit from below and/or above, but alternatively or additionally also with respect to the disclosure of one or a plurality of singular values from the respectively stated range.

The linkage is in particular provided in each case in that the respective pressing members are arranged side by side in the circumferential direction, optionally also arranged overlapping each other in a partial region. They can still be handled when linked together in this manner. Also, when being detached from the other linkage, the pressing members within the respective linkage are held together.

The inner pressing members 6 are acted on for press-joining only by the outer pressing members 2, 3, 4 and 5. The pressing jaws 11, 12 which belong to a pressing apparatus which is not illustrated in detail and, e.g., is driven hydraulically or by an electric motor, act directly, optionally via the connecting bars 13, 14, only on the outer pressing members 2, 3, 4 and 5 of the outer linkage. The pressing force is transmitted by these outer pressing members 2, 3, 4 and 5 of the outer linkage only by means of the mentioned interacting surfaces 9, 10 onto the inner pressing members 6 of the inner linkage.

The inner pressing members 6 are held between linkage parts 15, 16 or (opposite thereto) linkage parts 17, 18 to form the inner linkage. The inner linkage is connected at one or preferably two places to the outer pressing members 2, 3, 4 and 5 of the outer linkage. In the exemplary embodiment, the connection of the linkage parts 15, 16 or (opposite thereto) linkage parts 17, 18 is provided by mounting brackets 19, 20 radially protruding over the linkage parts 15, 16, 17, 18. Said mounting brackets 19, 20 are secured to the linkage parts 15, 16, 17, 18 by a connection which usually can not be untightened or only by time-consuming use of tools, but are more preferably secured to the outer linkage via a connection that can be untightened in a simple manner, here, a screw connection that can be untightened in a simple manner, more preferably secured by means of wing screws 21, 22.

This fastening is preferably provided two-sided, thus on opposite sides with respect to a center plane of the pressing device 1 which center plane extends transverse to the pressing direction. Thus, for exchanging an inner linkage of the exemplary embodiment, the four wing screws 21, 22 are to be untightened, whereupon the inner linkage can be removed and, if necessary, can be replaced by a second one.

By exchanging the inner linkage of second pressing members 6, an adaptation to another geometry of the compression parts to be joined by pressing can be achieved in a simple manner. It is further preferred here that the interacting surfaces 7, 8 remain the same but that, e.g., the curvature of an inner interacting surface 30 provided for pressing onto the compression parts changes. Alternatively or additionally, it is also possible that an inner pressing member 6 of a further linkage of inner pressing members 6 is formed with a radial extent that is different from that of an inner linkage of inner pressing members 6.

The inner pressing members 6 preferably have in each case an identical plan view. Within the context of this patent application, the plan view is to be understood with respect to a view in the direction of a longitudinal axis of a hose part to be joined by pressing, for example. More preferably, the plan view of the inner pressing members 6 has a trapezoidal shape and widens radially outward. More preferably, the narrow faces of the trapezoid, still viewed in a plan view, are formed here differently from a straight line, namely preferably arc-shaped with respect to the radially inner acting surface 30 and angle-shaped with respect to the outer narrow face of the trapezoid and, accordingly, are formed here by the partial surfaces of the interacting surfaces 7 and 8. More preferably, the angle shape is convex.

For radial movement, the inner pressing members 6 are guided in the linkage parts 15, 16, 17, 18. In the exemplary embodiment, and preferred, radially extending oblong holes 31 are formed in the linkage parts 15, 16, 17, 18, wherein in said oblong holes 31, an engagement rib 32 engages which is formed on an inner pressing member 6. The engagement rib 32 is adapted to the contour of an oblong hole 31, but has a shorter extent in the radial direction.

Furthermore, the engagement rib 32 is connected to the respective linkage part 15, 16, 17, 18 by means of a fastening means which, in the exemplary embodiment, is configured as a fastening screw 33. As is apparent, a fastening screw 33 has a diameter which exceeds the width of an oblong hole 31 and, accordingly, the screw 33 rests with said diameter in the connected state on top of the linkage part 15, 16, 17, 18. The connection has no clamping effect so that the inner pressing members 6 can move in the radial direction relative to the linkage parts 15, 16, 17, 18.

Figure 6:
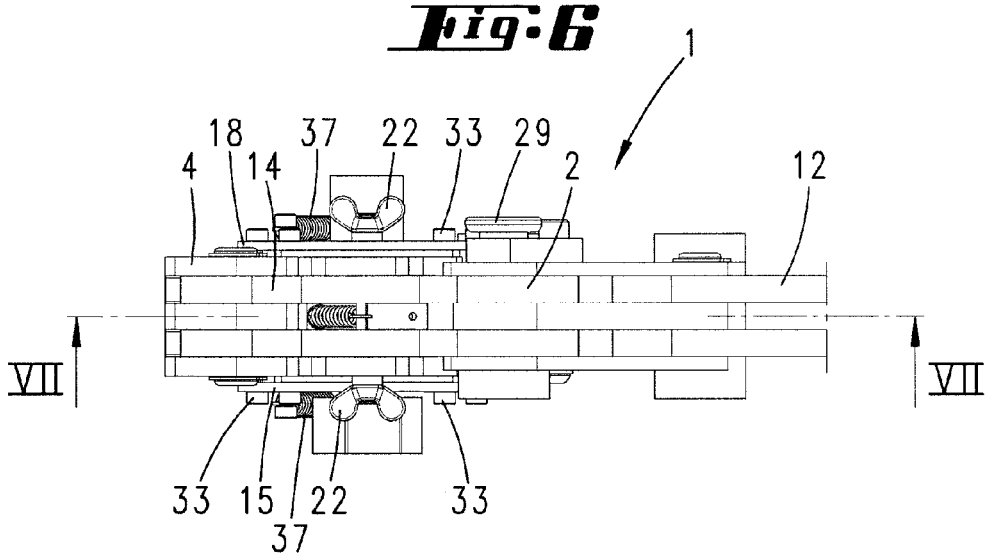
FIG. 6 shows a side view of the arrangement according to FIG. 5.

The connection of the inner pressing members 6 to the linkage parts 15, 16, 17, 18 is provided at the front faces of the latter which, in the side view, for example according to FIG. 6, of the pressing device 1, are formed on the upper and lower sides. In this direction of the extent which corresponds to the axial direction of the compression parts to be joined by pressing, the inner pressing parts 6 are preferably longer than in the mentioned radial direction.

With respect to the linkage parts 15, 16, 17, 18, the inner pressing parts 6 are arranged projecting radially inward, whereas more preferably, said pressing parts 6 are arranged in this case vertically overlapping on the radially outer side with the linkage parts 15, 16, 17, 18.

Figure 5:
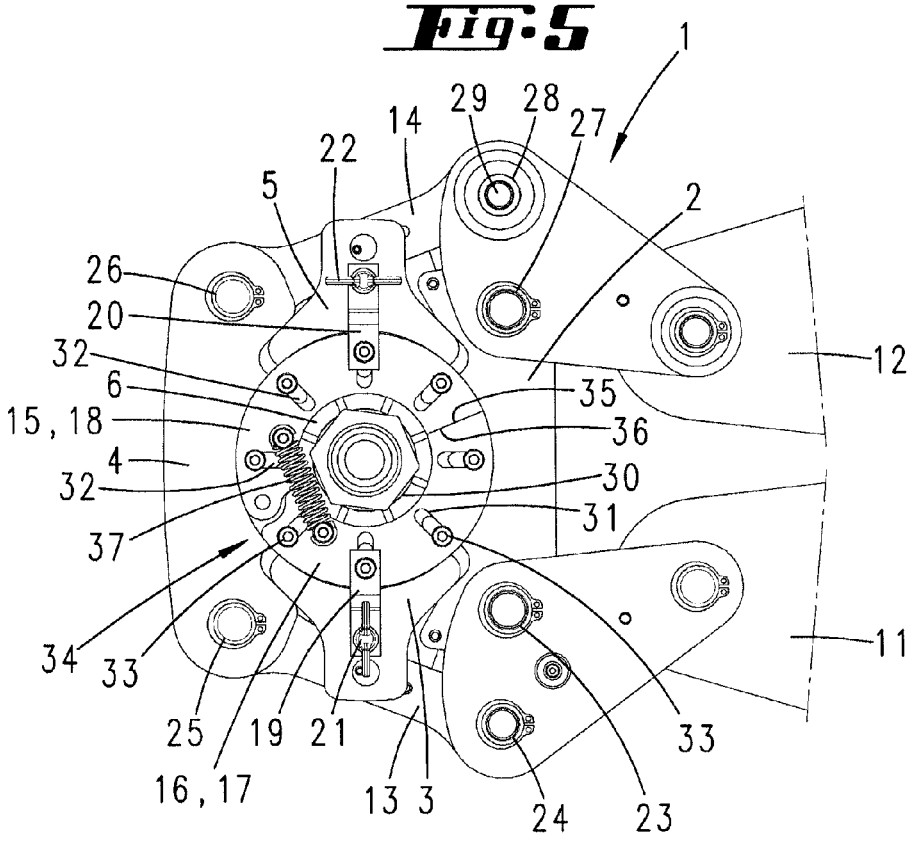
FIG. 5 shows an illustration according to FIG. 2 in the closed position of the pressing device with a fitting and a hose part arranged therein.

The linkage parts 15 and 16 or 17 and 18 are connected to each other at an articulated joint connection so that they can be swiveled open relative to one another in a manner as shown for example in FIG. 1 or 2 so as to allow compression parts to be enclosed. At the opposing ends 35, 36 of the linkage parts 15 and 16 or 17 and 18, the latter are in each case preferably not connected to each other and preferably cannot be connected to each other. When surrounded in the pressing state by the linkage of the outer pressing members, see for example FIG. 5, the linkage parts 15 and 16 or 17 and 18 merely rest there—preferably flatly—against one another.

More preferably, the inner linkage is additionally provided with one or two tension springs 37 which are arranged on opposite sides and are arranged overlapping with respect to the articulated joint connection.

With respect to the inner pressing members 6, most preferably, in each case three or more, preferred four, but also up to eight pressing members 6 are associated with one linkage part 16 or 17 or 15 or 18.

With respect to the outer pressing members 2, 3, 4, 5, preferably four pressing members are provided.

Figure 7:
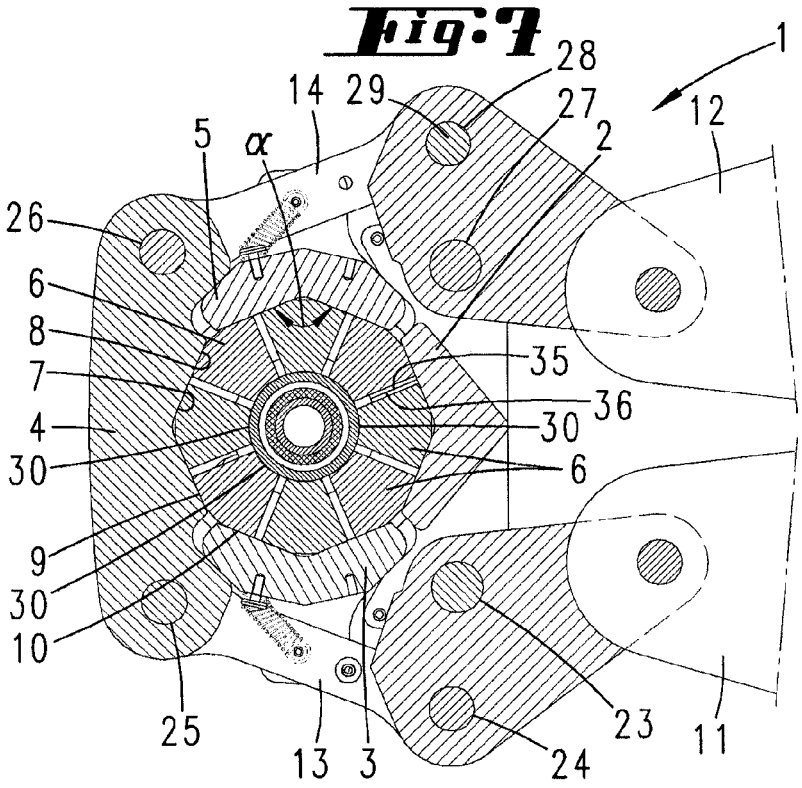
FIG. 7 shows a cross-section through the subject matter according to FIG. 5 and FIG. 6 along the plane VII-VIII in FIG. 6.
Figure 8:
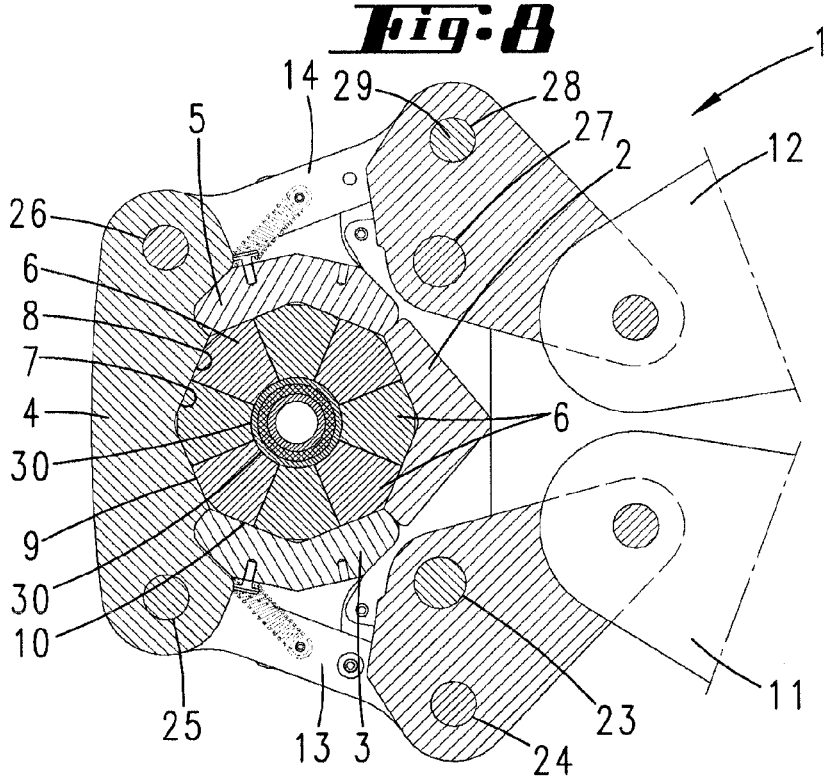
FIG. 8 shows an illustration according to FIG. 7 in the pressing state.

During a pressing operation, as is apparent from the difference of the FIGS. 7 and 8, some of the inner pressing members 6 move relative to the associated outer pressing members, but in other cases, namely as regards the pressing members 6 which are arranged centrally with respect to an outer pressing member, they do not move relative to said outer pressing member. In this case, the pressing members 6 move radially inward only together with the outer pressing member. The pressing members 6 moving relative to each other perform a relative movement in the circumferential direction. This relates to those pressing members 6 which are acted on at the same time by two outer pressing members.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive refinement of the prior art, in particular to undertake divisional applications based on these claims.

REFERENCE LIST

1 Pressing device
2 Outer pressing member
3 Outer pressing member
4 Outer pressing member
5 Outer pressing member
6 Inner pressing member
7 Interacting surface
8 Interacting surface
9 Interacting surface
10 Interacting surface
11 Pressing jaw
12 Pressing jaw
13 Connecting bar
14 Connecting bar
15 Linkage part
16 Linkage part
17 Linkage part
18 Linkage part
19 Mounting bracket
20 Mounting bracket
21 Wing screw
22 Wing screw
23 Articulated joint
24 Articulated joint
25 Articulated joint
26 Articulated joint
27 Articulated joint
28 Articulated joint
29 Connecting pin
30 Acting surface
31 Oblong hole
32 Engagement rib
33 Fastening screw
34 Articulated joint arrangement
35 End
36 End
37 Tension spring
$\alpha$ Angle While a preferred embodiment of the present invention is shown and described, it is envisioned that those skilled in the art may devise various modifications of the present invention without departing from the spirit and scope of the appended claims.

The invention claimed is:

1. A pressing device for press-joining a tubular or hose-shaped workpiece with a fitting and/or a ferrule, comprising:

a plurality of inner pressing members, each said inner pressing member having an inner surface and first and second outer surface portions, said outer surface portions being straight when viewed in plan view and being angled relative to each other at an angle of less than 180°, said inner pressing members arranged circumferentially next to each other and connected to each other to form an inner linkage such that each said first outer surface portion is adjacent to the second outer surface portion of the adjacent inner pressing member;

at least three outer pressing members, each said outer pressing member having first and second inner surface portions and an outer surface, said inner surface portions of said outer pressing member being straight when viewed in plan view and being angled relative to each other at an angle of less than 180°, said outer pressing members arranged circumferentially next to each other and connected to each other to form an outer linkage such that each said first inner surface portion is adjacent to the second inner surface portion of the adjacent outer pressing member;

said inner linkage seated within said outer linkage and generally forming a circle to define a circumference, said outer surface portions of said inner pressing members and said inner surface portions of said outer pressing members forming interacting surface portions, said inner and outer pressing members engaging each other in the radial direction along said interacting surface portions, wherein a pressing force is transmitted through said engagement of said interacting surface portions, and wherein said inner and outer pressing members can move relative to each other in the circumferential direction.

2. The device according to claim 1, wherein at least twice as many inner pressing members as outer pressing members are provided.

3. The device according to claim 1, wherein a circular shape is formed by said inner surfaces of said inner pressing members in plan view.

4. The device according to claim 1, wherein said inner linkage includes a plurality of linkage parts joined together, wherein each linkage part includes guides, said inner pressing members engaging within said guides to limit movement of said inner pressing members relative to said respective linkage part only to radial movement.

5. The device according to claim 4, wherein three or more of said inner pressing members are mounted in each linkage part.

6. The device according to claim 4, wherein at least two of said linkage parts are pivotable relative to each other for opening said second linkage.

7. The device according to claim 4, wherein each said second pressing members has inner and outer surfaces which extend radially, and side surfaces which face axially, said linkage parts being connected to said side surfaces.

8. The device according to claim 1, wherein three of said inner pressing members engage against each of said outer pressing members.

9. The device according to claim 1, wherein with regard to predetermined ones of said inner pressing members, each said first outer surface portion thereof engages a second inner surface portion of one said outer pressing member, and each said second outer surface portion thereof engages the first inner surface portion of the adjacent outer pressing member.

10. A pressing device for press-joining a tubular or hose-shaped workpiece with a fitting and/or a ferrule, comprising:

a plurality of outer pressing members connected together in an outer linkage, at least one of said outer pressing members transmits pressing force only by pressure or tension application to another one of said outer pressing members in said outer linkage, said outer pressing members of said outer linkage only capable of moving radially;

a plurality of inner pressing members joined together to form an inner linkage for surrounding the workpiece, said inner pressing members being separate members from said outer pressing members, said inner linkage positioned within said outer linkage, said inner linkage is formed prior to being positioned within said outer linkage, wherein the inner pressing members can be acted on only by said outer pressing members for pressing the workpiece.

11. The device according to claim 10, wherein at least twice as many inner pressing members as outer pressing members are provided.

12. The device according to claim 10, wherein each said inner pressing member has inner and outer surface portions, said outer surface portions of said inner pressing members are formed convexly, and each said outer pressing members has inner and outer surface portions provided thereon, said inner surface portions of said outer pressing members are formed concavely.

13. The device according to claim 12, wherein a circular shape is formed by said inner surface portions of said inner pressing members in plan view.

14. The device according to claim 10, wherein each said inner pressing member has inner and outer surface portions, a circular shape is formed by said inner surface portions of said inner pressing members in plan view, and each said outer pressing members has inner and outer surface portions provided thereon.

15. The device according to claim 14, wherein a non-circular shape is formed by said outer surface portions of said inner pressing members in plan view.

16. The device according to claim 14, wherein each said inner pressing member has inner and outer surface portions, a non-circular shape is formed by said outer surface portions of said inner pressing members in plan view, and each said outer pressing members has inner and outer surface portions provided thereon.

17. The device according to claim 10, wherein said second linkage includes a plurality of linkage parts joined together, wherein each linkage part includes guides, said inner pressing members engaging within said guides to limit movement of said inner pressing members relative to said respective linkage part only to radial movement.

18. The device according to claim 17, wherein three or more of said inner pressing members are mounted in each linkage part.

19. The device according to claim 17, wherein at least two of said linkage parts are pivotable relative to each other for opening said second linkage.

20. The device according to claim 17, wherein each said second pressing members has inner and outer surfaces which extend radially, and side surfaces which face axially, said linkage parts being connected to said side surfaces.

21. The device according to claim 10, wherein three of said inner pressing members engage against each of said outer pressing members.

* * * * *